US006203248B1

(12) United States Patent
Childers et al.

(10) Patent No.: US 6,203,248 B1
(45) Date of Patent: Mar. 20, 2001

(54) SLIDING-RESISTANT BOTTOM-FOUNDED OFFSHORE STRUCTURES

(75) Inventors: Mark A. Childers, Spring; David Rowan, Houston; Alan Quintero, Cypress, all of TX (US)

(73) Assignee: Atwood Oceanics, Inc., Houston, TX (US)

( * ) Notice: Subject to any disclaimer, the term of this patent is extended or adjusted under 35 U.S.C. 154(b) by 0 days.

(21) Appl. No.: 09/497,445

(22) Filed: Feb. 3, 2000

(51) Int. Cl.[7] ..... E02D 11/00; E02D 13/00; E02D 9/00

(52) U.S. Cl. ..... 405/227; 405/195.1; 405/224; 405/224.1; 405/228; 114/296

(58) Field of Search ..... 405/195.1, 224, 405/224.1, 227, 228; 114/296

(56) References Cited

U.S. PATENT DOCUMENTS

| | | | | |
|---|---|---|---|---|
| 2,994,202 | * | 8/1961 | Knapp et al. | 405/224 |
| 3,496,900 | * | 2/1970 | Mott et al. | 114/296 |
| 3,602,320 | * | 8/1971 | Howard | 175/8 |
| 3,797,256 | * | 3/1974 | Giblon | 405/196 |
| 3,846,991 | * | 11/1974 | Wisotsky | 405/228 |
| 3,922,869 | * | 12/1975 | Wisotsky | 405/228 |
| 3,965,687 | * | 6/1976 | Shaw | 405/224.1 |
| 4,086,866 | * | 5/1978 | Nixon | 114/295 |
| 4,184,790 | * | 1/1980 | Bassett | 405/227 |
| 4,257,721 | * | 3/1981 | Haynes | 405/227 |
| 4,270,480 | * | 6/1981 | Hancock et al. | 114/296 |
| 4,318,641 | * | 3/1982 | Hogervorst | 405/224 |
| 4,362,439 | * | 12/1982 | Vaynkof | 405/228 |
| 4,558,744 | * | 12/1985 | Gibb | 405/226 |
| 4,575,282 | * | 3/1986 | Pardue, Sr. et al. | 405/228 |
| 4,664,557 | * | 5/1987 | Hodge | 405/195 |
| 4,819,730 | * | 4/1989 | Williford et al. | 405/195 |
| 5,927,904 | * | 7/1999 | Treu et al. | 405/224 |

FOREIGN PATENT DOCUMENTS

| | | | | |
|---|---|---|---|---|
| 2011116 | * | 9/1971 | (DE) | 405/228 |
| 1492562 | * | 11/1977 | (GB) | 405/228 |

* cited by examiner

*Primary Examiner*—William Neuder
*Assistant Examiner*—Alexandra K. Pechhold
(74) *Attorney, Agent, or Firm*—Michael P. Breston

(57) ABSTRACT

A bottom-founded offshore structure in relatively shallow waters is protected against sliding. It uses at least one pile and a suction pump inside the pile. The pile has a length-to-diameter ratio such as to achieve sufficient pile imbedment with the selected suction pump. A dedicated pile lowering and lifting device lowers and lifts the pile as needed. Guides allow the pile's vertical motion and limit its rotational motion during imbedment and extraction. A stop device limits the vertical motion of the pile's top rim during pile extraction. The pile is reusable, light weight, easy to install and to extract, self-contained, and economical in relationship to its high holding power when imbedded.

30 Claims, 7 Drawing Sheets

45
74
79
78
78
85
84
83
86
72
82
29
76
40e
30
87
40h
28
40f
40

SLIDING-RESISTANT BOTTOM-FOUNDED OFFSHORE STRUCTURES

BACKGROUND OF THE INVENTION

1. Field of the Invention

This invention generally relates to suction piles for use with bottom-founded offshore structures resting in relatively shallow waters in which environmental conditions can present severe lateral load threats sufficient to displace and shift the structures from their normal rest positions.

2. Description of the Prior Art

Bottom-founded, mobile or stationary, submersible structures are required in various types of offshore operations, including scientific surveys and oil and gas drilling and production facilities.

The known relevant prior art includes bottom-founded offshore structures and, particularly, but not exclusively, mobile or stationary submersible platforms for carrying out oil and gas drilling and production operations throughout the world but primarily within the continental shelf of the Gulf of Mexico, especially in its Louisiana zone, which continues to be under intense investigation for its potential oil and gas resources. These types of water zones are of great concern to operators of bottom-founded mobile or stationary submersible structures, because they are prone to experience environmental lateral load threats that can create formidable obstacles to achieving uninterrupted use of fixed bottom-founded, drilling and production offshore installations.

Under normal operating conditions, the horizontal or lateral loads, generated by strong winds, heavy seas, wave surges, subsea currents, and shifting soft soil layers, are generally insufficient to cause a structure to slide from its rest position, because the natural shear forces between the foundation layers, and the frictional forces at the interface between the structure bottom and the seabed, combine to provide to the structure adequate resistance against its bottom sliding over the seabed within its seaway location.

However, under severe and often unexpected operating conditions, the combined shear and frictional forces can be over-powered, as during the hurricane season or other such environmental events, to cause the structure to slide or shift from its rest position on the seabed. This dreaded structure sliding or shifting phenomenon is known in this insular art as the "bottom sliding problem".

Of course, any sliding, even over a minor distance, can disrupt the vertical alignment between the structure and the oil or gas well under it, and produce potential catastrophic consequences from damaged wellheads, associated equipments, ruptured pipes, hydrocarbon spillovers into the sea, etc.

It is important to note that, because environmental and operational conditions are distinct within shallow warm waters, shallow ice waters, and deep water regions, the respective platform arts have become separate and distinct, as is well known to those skilled in these arts. Even in large, integrated oil corporations, workers in these distinct water regions operate within different corporate divisions, which frequently are under separate managements.

Over the years, operators in the shallow waters of the Gulf of Mexico have made many attempts to find a reliable, dependable, and economical technical solution to this bottom sliding problem.

A "slender-pile" approach to solving the bottom sliding problem involved driving into the sea bottom, through hull-attached guides, long slender piles having length-to-diameter ratios on the order of 30:1. Typically, these slender piles were 16, 20 or 30 inches in diameter and more than 50 feet long. Such slender piles frequently failed to supply enough additional sliding resistance to prevent the submersible structure from sliding in response to mild-to-moderate environmental loads. In addition to being costly, unreliable, time consuming to imbed and to extract, these slender piles proved to be uneconomical and operationally disadvantageous to potentially reduce the bottom sliding problem. Using larger diameter piles in sufficient numbers could have increased the structure's sliding resistance, but such piles would have been too heavy, expensive and time-consuming for the structure's cranes to lift, install, and extract.

A "skirt" approach to solving the bottom sliding problem, which is still being used, relies on adding a bottom skirt to an offshore structure so that it will self-penetrate into soft seabeds and thus hopefully increase the platform's frictional resistance capacity at the interface with the seabed. But such a skirt can hardly be expected to penetrate into dense or clay formations. Even in soft seabeds, the skirt's frictional resistance capacity increase is at best unreliable, erratic and unpredictable.

A "gravity" approach, which can be combined with the "skirt" approach, relies on adding extra weight at least to the bottom section of the structure, as by using concrete, in full or in part, as the building material for the walls and floors of the structure. This gravity approach can increase substantially the cost of building the structure and, in any event, does not altogether eliminate the bottom sliding problem.

A more recent approach, for use in the arctic shallow water regions of Canada and Alaska, is described in U.S. Pat. No. 4,579,481. A concrete-steel drilling platform 10 uses dozens of spud piles 42 within the peripheral walls of its substructure 12. Piles 42 are designed for use in about fifty feet mean arctic water depths. Each pile 42 has a 7' diameter and a 110' length, yielding a length-to-diameter ratio of about 16:1. A highly complex mechanical bushing 60, between each pile and the platform structure, is used for load transfer, in a manner as to allow the misalignment of pile 42 via pivoting of the bushing. Under over-load conditions, and prior to inflicting damage to the platform itself, spud piles 42 are permitted to flex between vertically-spaced-apart fulcrum points, which is to be expected in view of their relatively high 16:1 length-to-diameter ratio. Each pile 42 is hung from a deck crane with its top end being above water to allow a pile driver or vibratory hammer to imbed the pile into the foundation beneath the seabed.

Typically, the cranes on such an oil-producing structure are of insufficient size and power to handle very long and heavy spud piles. Using larger cranes is not practical because they would occupy precious deck space needed for carrying cargo, and also would interfere with normal deck operations. To avoid such problems, large cranes and pile drivers on auxiliary vessels are employed for pile imbedment and extraction.

But, such external equipments and services may not be available on short notice, especially under abnormal operating conditions, generated by strong winds, heavy seas, wave surges, subsea currents, storms or the like. Therefore, it is frequently more convenient to just sever the already installed piles, abandon them in the ground, and treat them as expendable albeit costly commodities.

SUMMARY OF THE INVENTION

Accordingly, it is the main object of the present invention to provide a new and improved, readily-reusable pile system, in combination with a bottom-founded offshore structure for use in relatively shallow waters, so as to empower the structure to better resist the unexpected large lateral forces, which may become exerted on the structure, especially in the Gulf of Mexico.

The improved, readily-reusable pile system includes at least one pile and an integrated, self-contained, self-installing, pile imbedment and extraction apparatus housed in the interior of the pile and on the structure. A pile guide housing projects outwardly of the structure. The guide housing forms a vertical, cylindrical, shaft or hole. A portion of the pile's outer wall is received within the cylindrical shaft between upper and lower pile guides to ensure free vertical up and down pile movements within the pile guides.

The preferred imbedment and extraction apparatus includes a suction pump selected for its size and power. The suction pump is ready on demand to be used for pile imbedment and extraction.

The suction pump can create on demand an under-pressure inside the pile that forcibly pushes and imbeds the pile into the earth foundation. After the first imbedment, it can be reused on demand, for example, to compensate for the settling or shifting of the soil layers within the foundation underneath the seabed.

A pressurized fluid, such as sea water or drilling mud, is pumped into the imbedded pile to create an over-pressure therein, which forcibly extracts the pile from the earth foundation. A diaphragm means inside the pile contains the under-pressure or over-pressure within the pile. The pile has drain holes to allow excess water to escape from the pile during its extraction, and to allow free-flooding the pile during its imbedment. If needed, jetting means are provided for directing high-pressure water to the pile's base to assist with its imbedment and extraction tasks. A penetrometer means is operatively associated with the pile to measure the extent of its penetration.

The pile should have a sufficient length-to-diameter ratio to achieve the desired pile imbedment with the selected suction pump. For best results, the length-to-diameter ratio should fall within the range of 0.5:1 to 5:1, which is a considerably lower length-to-diameter ratio range than that used for the standard, slender, mechanically-driven, long piles above described.

The preferred apparatus further includes a dedicated lowering and lifting device for lowering the pile during imbedment from its raised rest position to the seabed, and for lifting it back up to its raised rest position during extraction.

Guide and stop means are coupled to the structure and to the pile, to (a) guide it down during its imbedment, (b) guide it up during its extraction, while at the same time preventing its rotational motion relative to its vertical axis, (c) stop it at its raised rest position, and (d) releasably secure the pile's top rim to an exterior wall of the structure for safe transit to another seaway location.

DESCRIPTION OF PREFERRED EMBODIMENTS

General Description

The words "platform", "vessel", "rig", "barge", "MODU", "unit", or "structure" are used interchangeably in this description.

The present invention provides a new and improved pile imbedment and extraction system 39 in combination with a bottom-founded, mobile offshore structure 42 for use in relatively shallow waters, typically those found in the Gulf of Mexico and the like.

Figure 1:
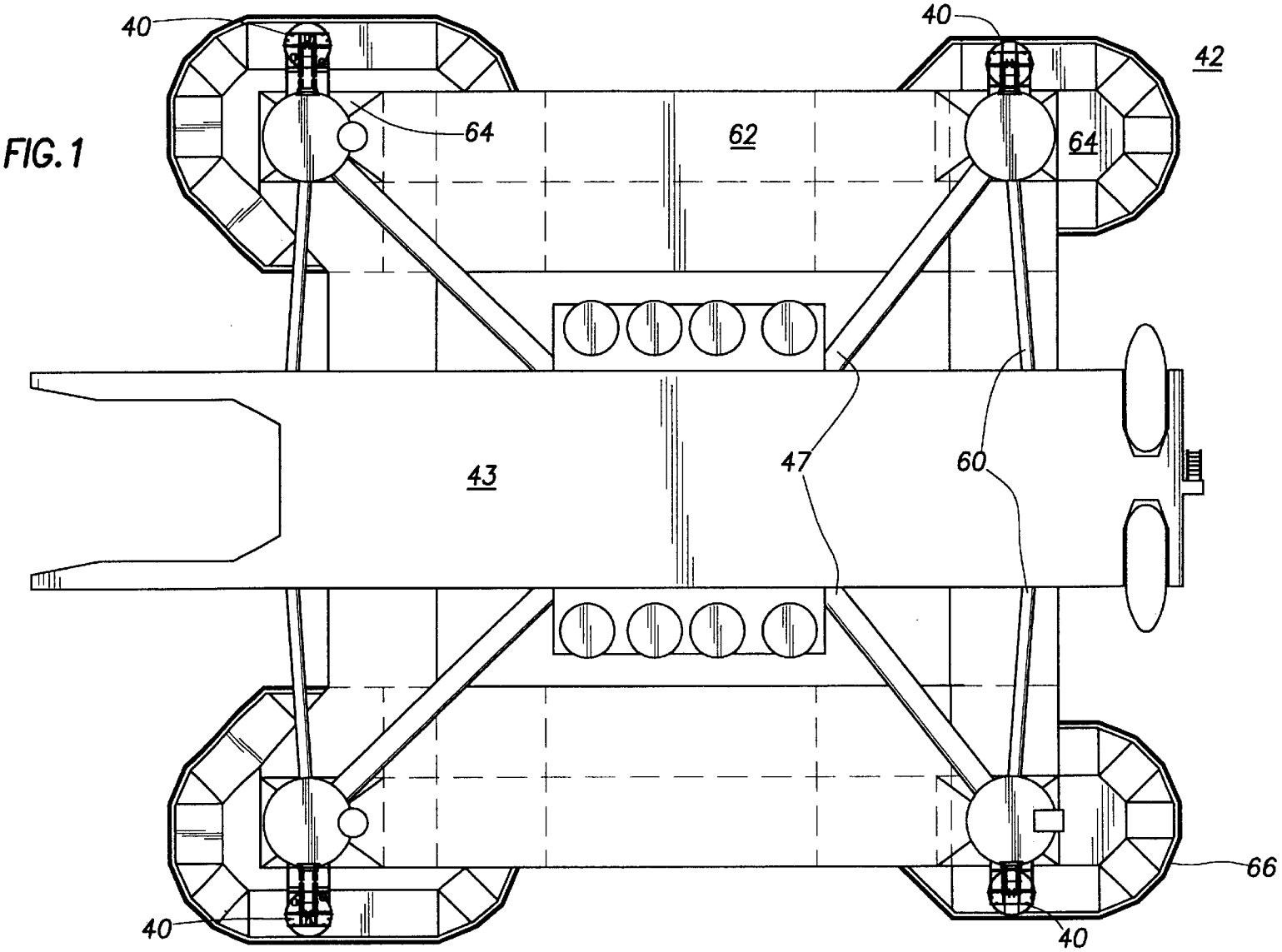
FIG. 1 is a general schematic plan view of a particular submersible Mobile Offshore Drilling Unit (MODU), shown positioned at an offshore installation site in a floating condition above the required seabed location, and shown with four identical columns operatively combined with the pile system of the present invention.

Structure 42 can be used for different purposes and can assume different configurations. The particular structure illustrated in FIG. 1 is a slide-resistant, bottom-founded, submersible, Mobile Offshore Drilling Unit (MODU) 42. It is positioned at an offshore installation site, in a floating condition on the required location above the seabed 48, ready for use in oil and gas drilling and production investigations and operations.

Under normal environmental conditions, the horizontal or lateral loads, generated by strong winds, heavy seas, wave surges, subsea currents, and shifting soft soil layers of substantial depth, are generally insufficient to cause a MODU 42 to slide from its rest position on seabed 48, because the natural shear forces between the earth foundation layers 48*a*, and the frictional forces at the interface between the unit's substructure 46 and seabed 48, together combine to provide adequate resistance against sliding within its seaway location.

But abnormal environmental conditions can present severe lateral load threats sufficient to cause the bottom of substructure 46 to slide over the seabed 48 from its normal rest position. Such sliding, even over a minor distance, can disrupt the vertical alignment between MODU 42 and the oil or gas well (not shown) under it, with potential catastrophic consequences.

Without the pile imbedment and extraction system 39 (FIGS. 2–7) of the present invention, MODU 42, in and by itself, is well-known in the relevant art as the "RICHMOND", owned and operated by the assignee of the instant application. Therefore, there is no need to describe MODU 42 in greater detail, except to the extent necessary for a person skilled in the art to understand the invention claimed herein.

MODU 42 has four columns 45. It has been modified to include the novel pile system 39, preferably having a pile 40 on each of its four columns 45. A single pile 40 on a single column 45 may be sufficient in some less severe environments. Pile system 39 empowers MODU 42 to better resist the unexpected large lateral forces, which may become exerted on it in the seaway, and thus to become slide-resistant.

Pile system 39 includes an integrated, self-contained, self-installing, pile imbedment and extraction apparatus 40*a* housed in the interior of pile 40 and on column 45. A pile guide housing 40*c* projects outwardly of substructure 46 of MODU 42. Guide housing 40*c* forms a cylindrical, vertical shaft or hole 63. A portion of the pile's outer wall 40*f* is received within shaft 63 between upper and lower pile guides 68 and 70 to (a) ensure free vertical up and down pile movements within the pile guides, (b) prevent pile 40 from undergoing lateral and/or rotational movements about a horizontal axis during imbedment and extraction, and (c) maintain the alignment of the flex hoses 17–20 (FIG. 2) relative to the pile's vertical center axis.

Apparatus 40*a* in its normal rest position (FIG. 2) is ready on demand to be used for pile imbedment and extraction. After the first imbedment, it can be reused on demand, for example, to compensate for the settling or shifting of the soil layers within the foundation 48*a* below the seabed 48. The preferred imbedment and extraction apparatus 40*a* includes a suction pump 50 that is selected on the basis of its size, power and other operational characteristics. By pumping water out of the pile, suction pump 50, and its associated equipments in apparatus 40*a*, can create on demand an under-pressure inside pile 40 that forcibly pushes and imbeds the pile into the earth foundation 48*a* underneath the seabed 48 (FIG. 7), as will be readily understood by those skilled in the art. It is the function of diaphragm 25 (FIG. 5) inside pile 40 to contain the under-pressure or over-pressure within chamber 40*i*.

To create the desired under-pressure, suction pump 50 must be below the outside water level (sea level). The upper water level just underneath diaphragm 25 must be below the outside water level, such that the seawater head on the outside is greater than the under-pressure created inside the chamber 40*i* of pile 40. The flow rate at which the seawater is withdrawn from pile chamber 40*i* must be such as to prevent sucking up a soil plug (not shown), which could fill up the pile chamber.

Conversely, by feeding a pressurized fluid, such as seawater or drilling mud into pile chamber 40*i* of the imbedded pile 40, apparatus 40*a* can create on demand a pressure therein which is higher than the outside seawater in order to push pile 40 upwards. The flow rate at which the seawater or drilling mud is pumped into pile chamber 40*i* must be such as to preclude fluid flow outside and around the pile base rim 40*g*, but sufficient enough to forcibly extract pile 40 from the particular earth foundation 48*a*.

Pile 40 has drain holes 26 to allow excess water to escape from above the pile water tight top 25 when pile 40 is out of the water, thus reducing its weight, and to allow free-flooding pile chamber 40*i* during its imbedment.

If needed, jetting means 21 are provided for directing high pressure water or another fluid to the pile's base rim 40*g* to assist with its imbedment and extraction tasks.

A penetrometer means 8 and penetrometer conduit 4 are associated with pile 40 to measure the extent of its penetration during its imbedment and extraction tasks.

Pile 40 should have a sufficient length-to-diameter ratio to achieve the desired pile imbedment, and a sufficient strength for use with the selected particular suction pump 50. For the particular MODU 42, the particular suction pump 50, and for the expected operational seaways, pile 40 has a 10' diameter and is 31' long, yielding a length-to-diameter ratio of about 3:1, which is a considerably lower length-to-diameter ratio than that used for the mechanically-driven, standard, slender long piles above described. It has been found theoretically and empirically that for best results, the length-to-diameter ratio should fall within the range of 0.5:1 to 5:1.

Figure 2:
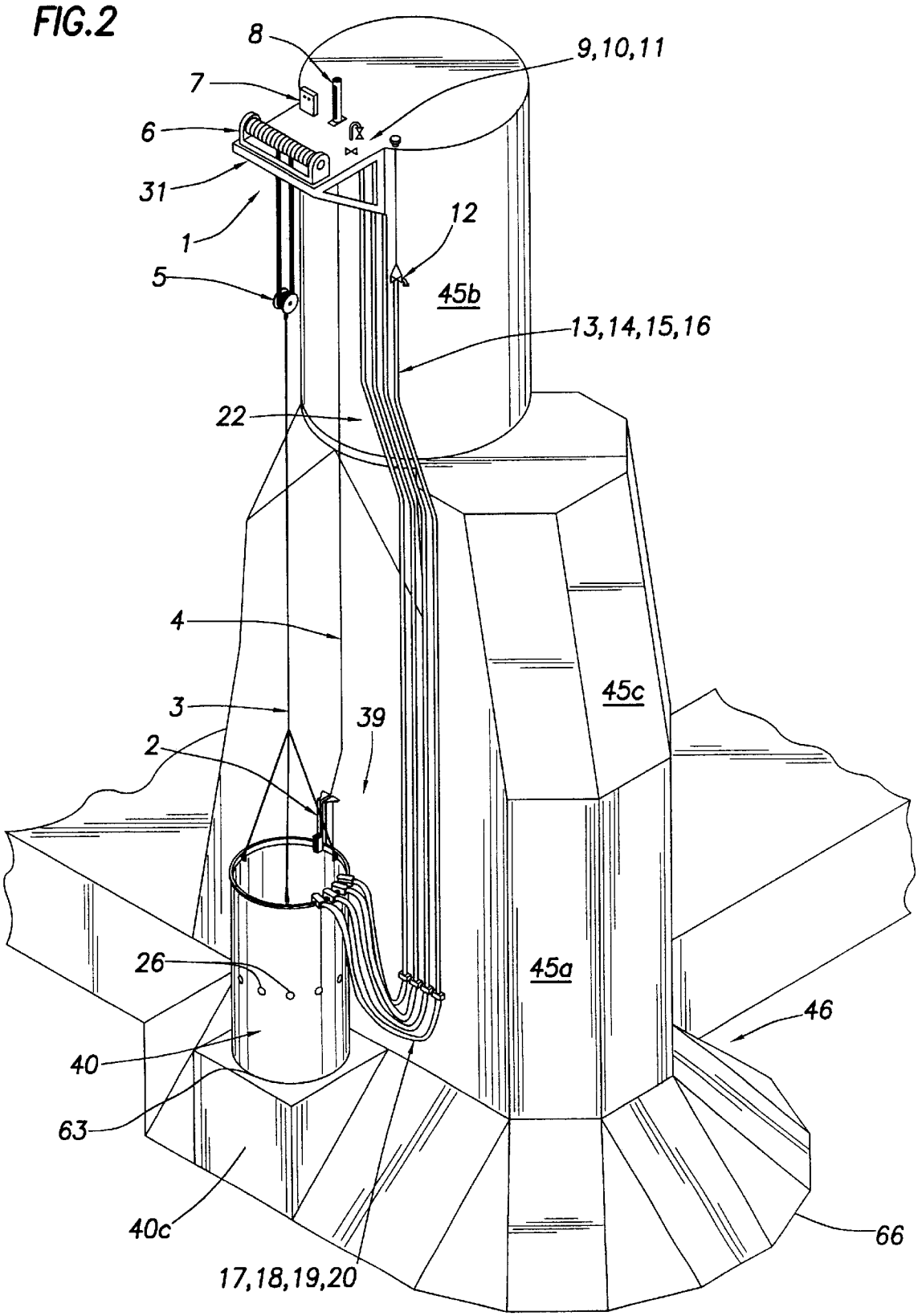
FIG. 2 is a schematic perspective view of one column showing the upper end portion of the pile at its uppermost fully raised rest position, a portion of the pile imbedment and extraction apparatus, and the pile guide housing.

Apparatus 40*a* further includes a dedicated pile lowering and lifting device 1 for lowering pile 40 during imbedment from its raised rest position, as shown in FIG. 2, to the seabed 48, and for lifting it back up to its raised rest position during pile extraction.

Pile guide and stop means 2 (FIGS. 3–4) are coupled to column 45 and to pile 40 to guide the pile vertically down during its imbedment, to guide it vertically up during its extraction, while at the same time preventing its rotational motion relative to its vertical axis, and to stop its upward motion when it reaches its raised rest position.

At the pile's raised rest position, a padeye 29 (FIGS. 4–5) and a locking pin 30 releasably secure the pile's top rim 40e to the exterior wall of column 45 for safe transit to another seaway.

In use, pile 40 serves as a rigid connector which is able to transfer sufficient lateral forces between MODU 42 and the earth foundation 48*a*, thereby precluding significant pile bending, as well as sliding of the MODU's bottom over the seabed 48, arising from high waves, storms and other such environmental disturbances.

DETAILED DESCRIPTION

As shown in FIG. 1, each column 45 incorporates the pile system 39 (FIG. 5) which includes a strong pile 40, preferably circular in cross section, and secured at its top end to a dedicated pile lowering and lifting device 1.

Each column 45 (FIG. 2) has a lower portion 45*a* which is rectangular in section from its base up to about 60 feet above the bottom of ring-shaped pontoon or hull 62, an upper portion 45*b* which is circular in section above about 74 feet, and a transitional middle portion 45*c* between 60 and 74 feet.

The top end of each column 45 has lateral structural members 47 (FIG. 1) that connect to the main deck 43 of MODU 42. Main deck 43 contains the machinery (not shown) required for carrying out drilling operations, storage areas for drilling equipment, crew accommodations, and it also acts as the drill floor supporting the main drilling derrick and related machinery (not shown). The main deck 43 is also supported by a supplementary framework 60 of tubular braces connected to the top end of hull 62 which makes contact with the seabed 48.

As shown in FIGS. 1–3 and 7, hull 62 is located at the starboard forward corner at the bottom of column 45. Hull 62 is secured to the top of each one of the four columns 45 and to tubular braces running up to the main deck 43 along its inner edge. Each column 45 is secured to hull 62 at its bottom. Tubular braces connect the hull's top to main deck 43. Supplementary box-shaped structures 64 are fitted to parts of vertical column 45 in order to enhance the stability of MODU 42 when afloat.

Columns 45 provide ballast to maintain the desired on-bottom weight, as well as sufficient buoyancy so that, when emptied of ballast, MODU 42 floats on its hull 62.

Supplementary wedge-shaped structures 66 (FIG. 1) are also fitted to the corners of hull 62 at its lower sides to act as protection for seabed 48, so that soil cannot be washed out from under hull 62 due to sea currents.

The integrated, self-contained, self-installing, pile imbedment and extraction system 39 (FIGS. 2–7) includes the dedicated pile lowering and lifting device 1, a pile guide and stop means 2, a control panel 7, valves 9–12, a piping network 22 having pipes 13–16, hoses 17, 19, 20, an umbilical power bundle 18, jet tips 21, a strainer 23, a diaphragm 25, a pile imbedment and extraction apparatus 40*a*, and the pile guide housing 40*c* projecting outwardly of the column base 45*a*.

Pile 40 houses the on demand, the self-installing pile imbedment and extraction apparatus 40*a*, preferably including a suction pump 50, whose size and power are selected to suit the pile imbedment and extraction requirements within the expected seaways.

Pile 40 is designed to have a sufficient length-to-diameter ratio to achieve pile imbedment using the selected suction pump 50. Preferably, the pile's length-to-diameter ratio is within the range of 0.5:1 to 5:1 to cover the types of seaways to be encountered by MODU 42 in the Gulf of Mexico. For MODU 42, the selected pile has a 10' diameter and is 31' long, yielding a sufficient length-to-diameter ratio of about 3:1.

The structure of hull 62 (FIGS. 1–3, 6–7) provides a structural foundation into which the suction pile guide housing 40*c* is slotted and welded up. Pile guide housing 40*c* is rectangular in shape and forms a cylindrical, vertical shaft or hole 63 which freely receives a portion of pile 40. The clearance between the pile's outer wall 40*f* and the upper and lower pile guides 68,70 (FIG. 6) within shaft hole 63 is just sufficient to overcome accumulated fabrication tolerances, and to ensure free vertical up and down pile movements within the pile guides 68,70.

The dedicated pile lowering and lifting device 1, preferably includes an air winch 6, wire 3, and tackle 5. Air winch 6 is mounted on a winch support platform 31 so as place the winch directly above the pile's center axis. Air winch 6 lowers the pile during pile imbedment from its raised rest position to the seabed, and lifts it back up to its raised rest position during pile extraction.

Figure 3:
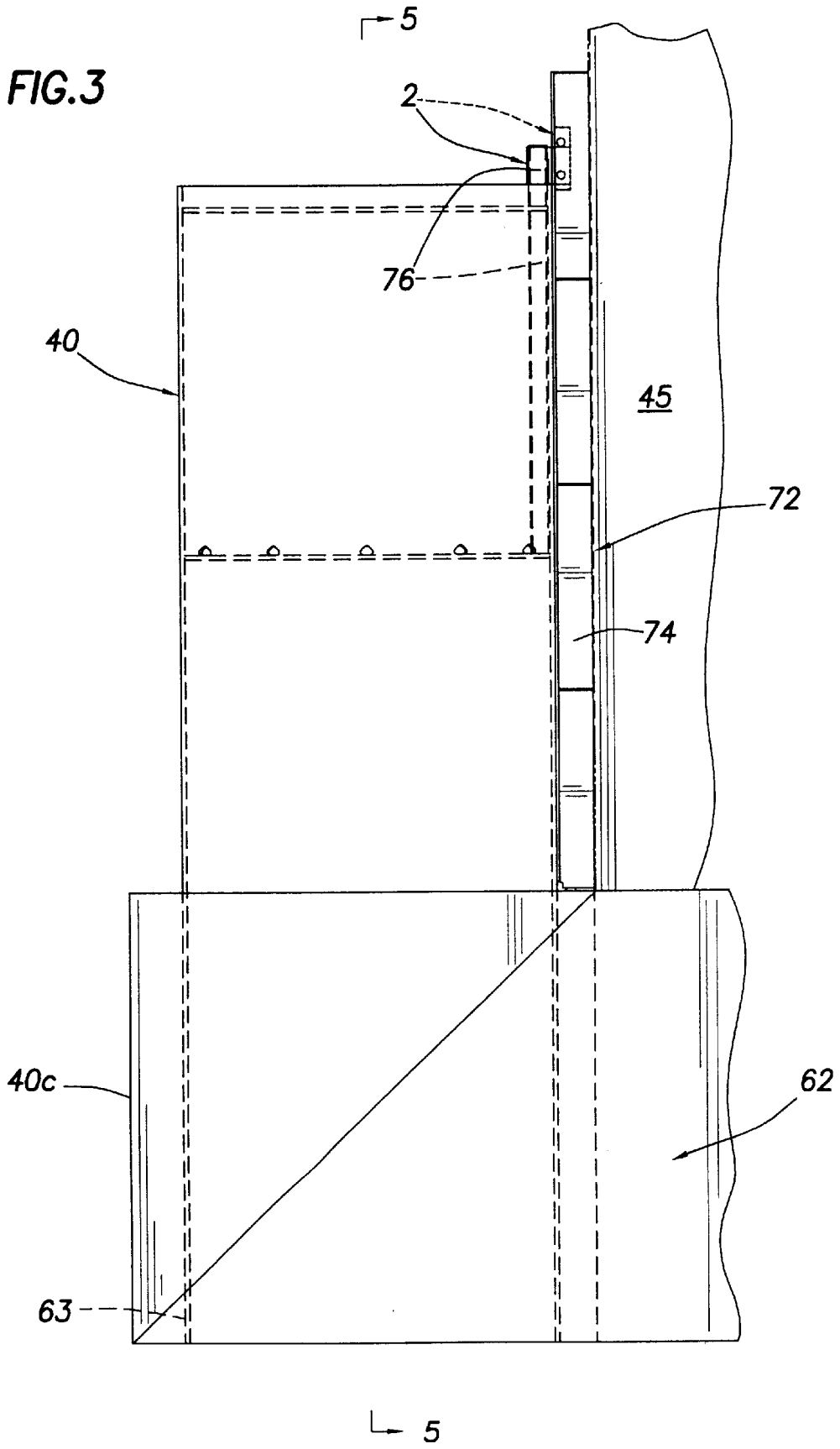
FIG. 3 is a schematic, fragmentary, vertical side or lateral view in elevation of the pile whose upper end is secured to the column and whose lower end portion is contained within the pile guide housing shown in FIG. 2.
Figure 4:
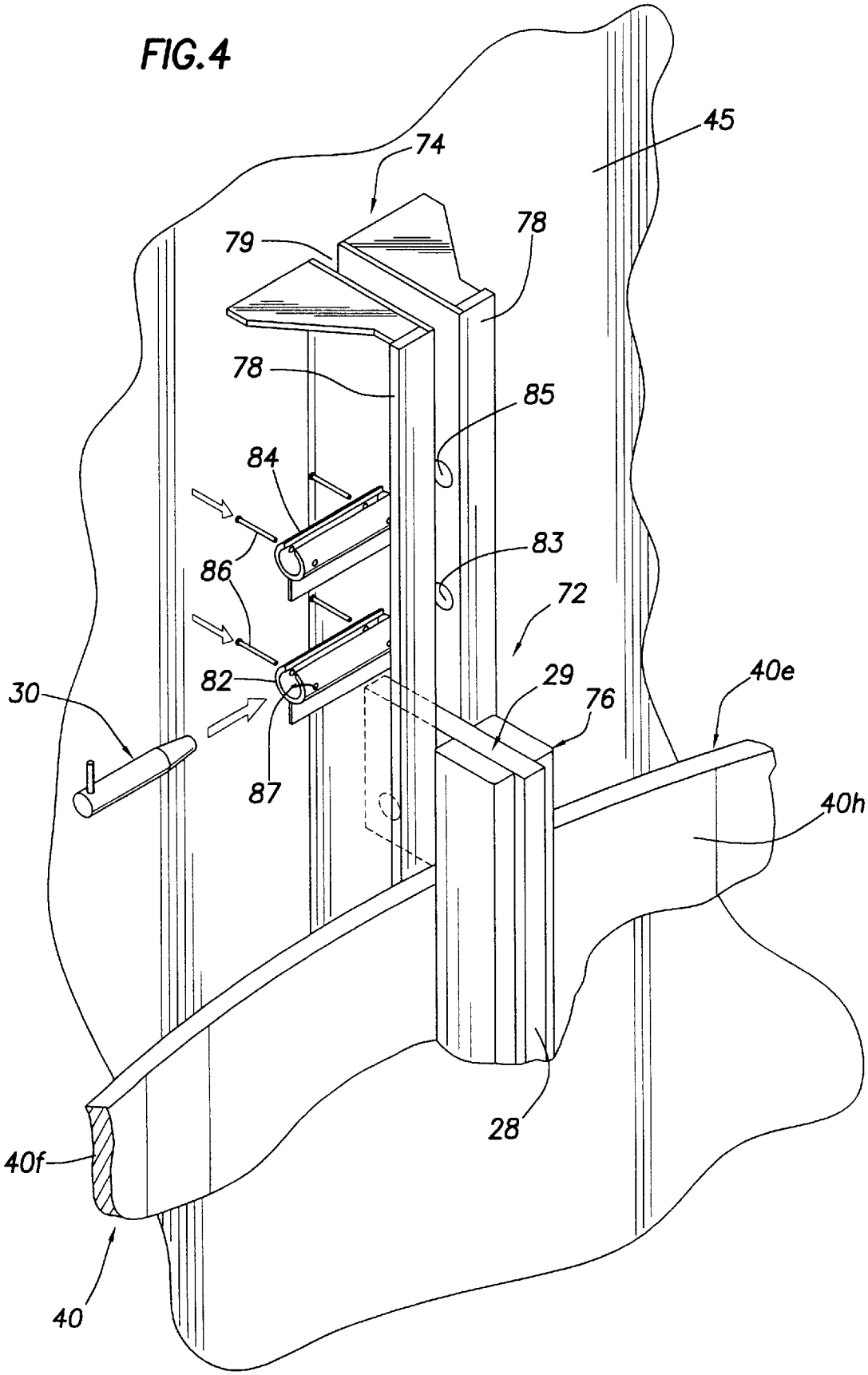
FIG. 4 is a fragmentary, perspective view showing the pile stop and guide means of FIG. 2.

FIGS. 2–4 show the pile's top rim 40*e* at its uppermost, fully-raised rest position on column 45 as well as the pile guide and stop means 2 which include a pile hang-off-bracket 72 having a stationary part 74 and a movable part 76.

Stationary column 45 provides a structural foundation into the outboard side of which stationary part 74 is securely welded (FIG. 3). The stationary part 74 is prismatic in shape and has a cross-section of two spaced-apart, back-to-back L-shape members 78. Stationary part 74 runs vertically up from the top of hull 62.

Movable part 76 is prismatic in shape, has a square tube cross-section, and is located inside of and is secured to the inner wall 40*h* of pile 40. It runs vertically up the pile's inner wall to just above its top rim 40*e*.

A flat padeye plate 28 is fixedly slotted into the upper end of the square tube of movable part 76. Padeye plate 28 has a flat shoulder which serves as a padeye 29 that radially and outwardly projects into groove 79 between the L-shaped members 78 (FIG. 4). Padeye 29 freely slides between the L-shaped members 78.

Movable part 76 moves with pile 40 since it is secured thereto. Padeye 29 guides the pile in its vertical up and down motions and at the same time limits the pile's rotation about its vertical center axis.

In addition to its guiding function, padeye 29 provides a means of locating the cylindrical hang-off or locking pin 30 either in a hang-off pin cradle 82, a hang-off pin hole 83, a locking pin cradle 84, or a locking pin hole 85.

The hang-off pin cradle 82 is a slotted cylindrical tube. It has a crescent shape in cross-section. Its function is to guide locking pin 30 into hang-off pin hole 83 and to hold locking pin 30 when needed. The locking pin 30 is secured by bolts 86 passing through bolt holes 87 in hang-off pin cradle 82 or in locking pin cradle 84.

The locking pin 30 when inserted into hang-off pin hole 83 prevents pile 40 from inadvertently being raised above the locking pin level and secures the pile against vertical movement. When it is desired to lift the pile up and out of its pile guide housing structure 40*c*, locking pin 30 is removed from hang-off pin hole 83.

In sum, padeye 29 detachably secures the top end of pile 40 with locking pin 30 to column 45, in the pile's normal, raised, uppermost rest position used for transit, as shown in FIG. 2, and, together with locking pin 30, padeye 29 limits the pile's upward vertical motion during extraction.

Figure 5:
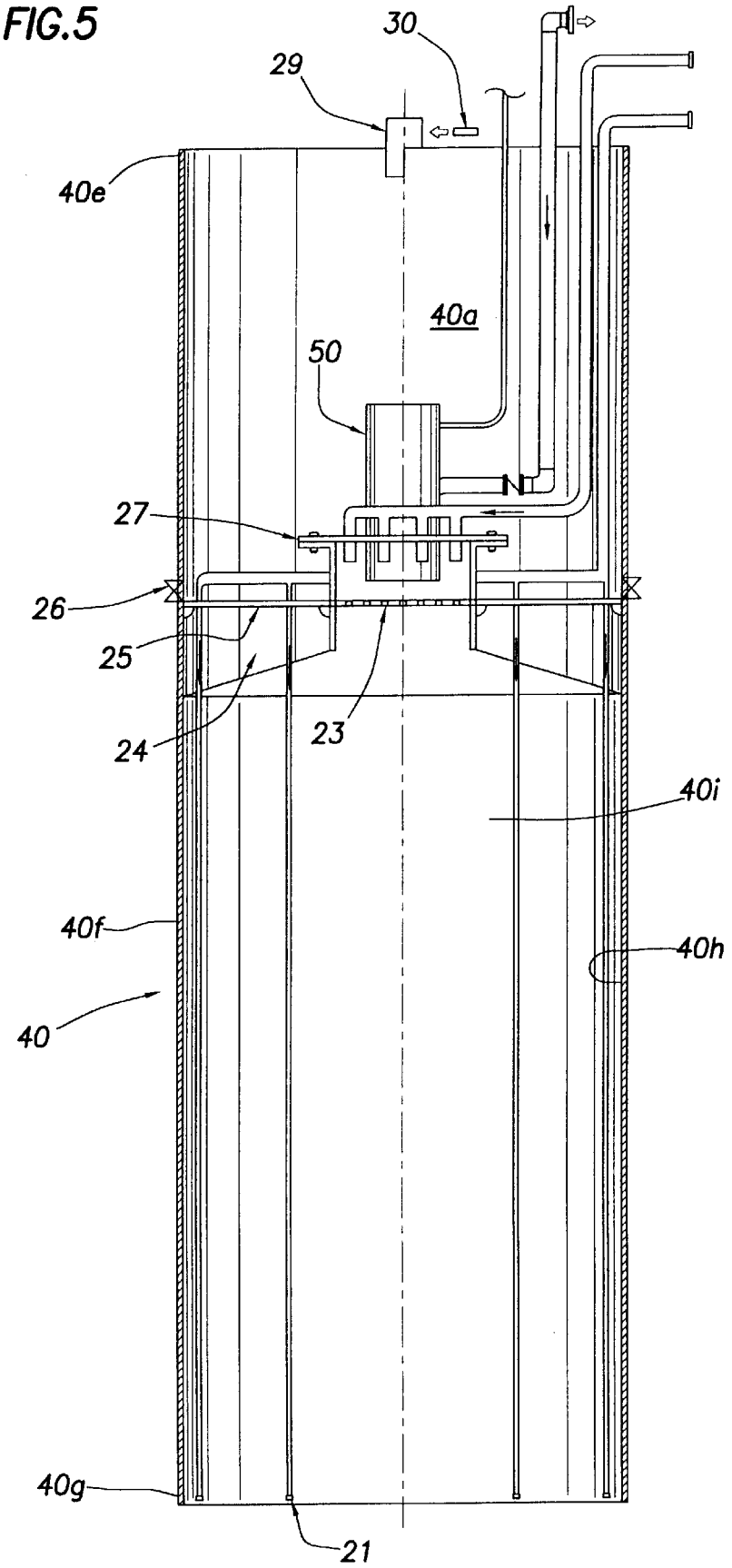
FIG. 5 is a schematic, vertical, diametrical section through the pile taken along line 5—5 of FIG. 3, showing the suction pump of the imbedment and extraction apparatus of FIG. 2.
Figure 7:
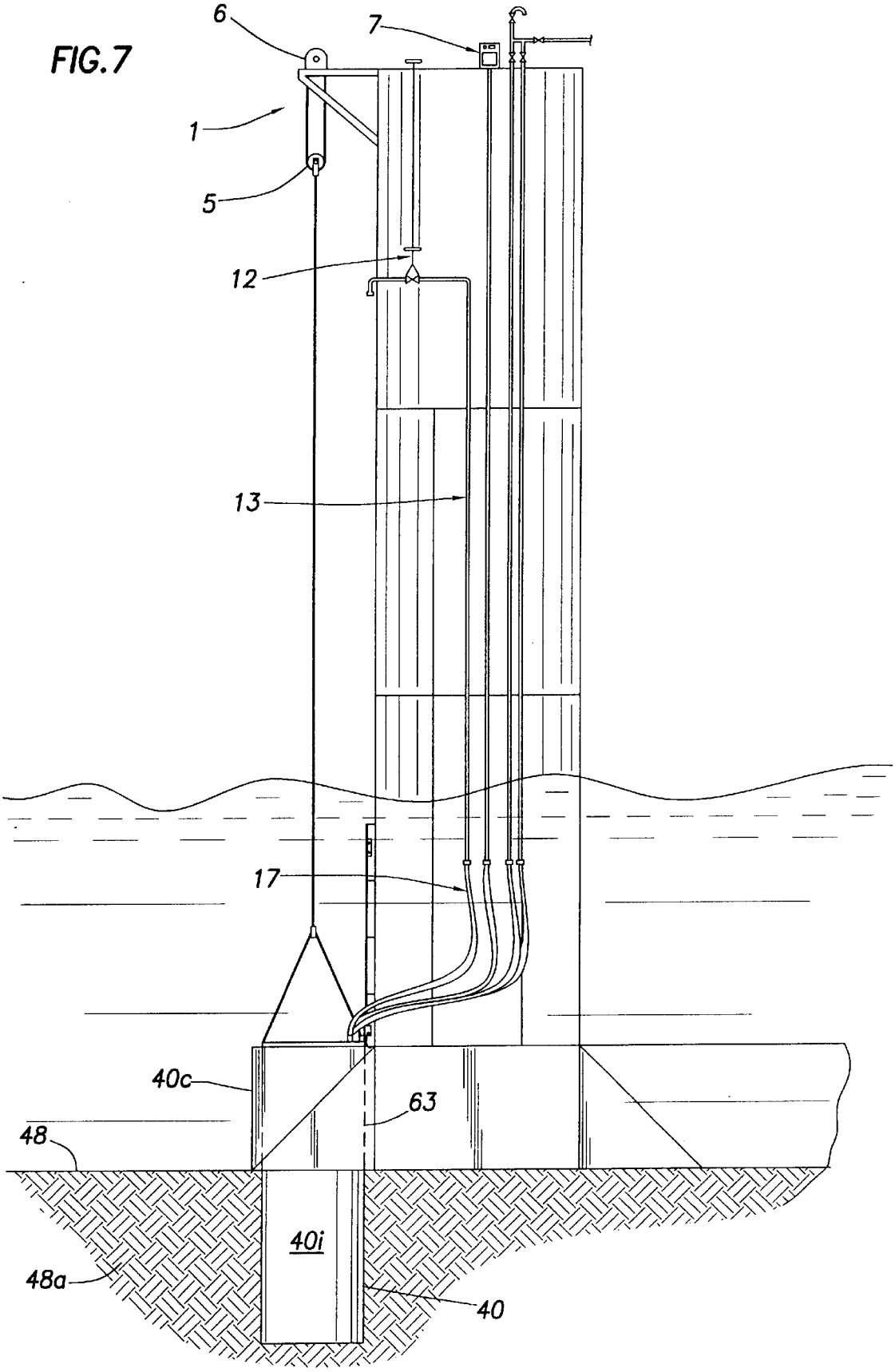
FIG. 7 is a schematic vertical, elevational side view, of the pile system shown in FIG. 2, but after the pile has been pushed to its lowermost level into the earth foundation.

The pile imbedment and extraction apparatus 40*a*, in addition to suction pump 50, further includes associated manifolds and control instrumentation means mounted on top of column 45 and within pile 40 (FIGS. 2, 5, 7).

Control panel 7 controls the operation of suction pump 50, which, in use, pumps out the water entrained within pile 40, thereby creating an under-pressure in the pile that pushes it into the earth foundation 48*a* underneath the seabed 48.

Penetrometer 8 and penetrometer conduit 4 measure the extent of pile 40 penetration.

Valve 9 vents air and/or water from pile 40 during its initial imbedment.

Valve-flush 10 flushes out debris from around the inlet to suction pump 50. It also provides over-pressure needed to force pile 40 out of the seabed when the extraction of the pile is desired.

Valve-jet 11 feeds high pressure water to jet pipes 16.

Valve-discharge 12 and discharge pipe 13 discharge water from suction pumps 50.

Conduit pipe 14 protects umbilical power bundle 18 which supplies power to suction pump 50 and to the control instrument panel 7.

Vent-fill pipe 15 vents air from pile 40 and supplies water to it.

Discharge flex hose 17 discharges water from pump 50.

Vent-flex hose 19 vents air from and supplies water to pile 40.

Jet pipe 16 supplies high pressure water to jet-flex hose 20, which in turn supplies high-pressure water to jet tips 21 for directing the high-pressure water to the base of pile 40 to assist with its imbedment task.

Discharge flex hose 17, umbilical power bundle 18, vent-flex hose 19 and jet-flex hose 20, each allows pile 40 free vertical movement during pile raising and lowering.

The strainer 23 within pile 40 prevents debris from entering suction pump 50.

The internal bracket 24 within pile 40 adds strength to its cylindrical wall.

The top plate 27 within pile 40 allows removal of the suction pump 50.

The diaphragm 25 within pile 40 contains the under-pressure during pile imbedment and its over-pressure during its extraction.

The pile 40 has drain holes 26 (FIG. 2) to allow excess water to escape from it during its extraction, and to allow free-flooding the pile during its imbedment.

Pile Deployment Sequence

In Step 1, MODU 42 is positioned in a floating condition above the required seabed 48 location.

In Step 2, MODU 42 is ballasted down onto the seabed 48. Prior to this operation, the locking pin 30 is removed from the securing padeye 29.

In Step 3, tackle 5, air winch 6 and wire 3 lower pile 40 over the seabed 48. Then the pile is allowed to penetrate under its own weight into earth foundation 48*a*. The amount of pile penetration will depend on soil conditions and the site characteristics. To allow any trapped air within pile 40 to escape, vent valve 9 at the top of column 45 is opened. The air can exit through vent-flex hose 19 and vent-fill pipe 15.

The self-penetration of pile 40 into soft seabeds 48 initially increases the MODU's frictional resistance capacity at the interface with seabed 48.

Figure 6:
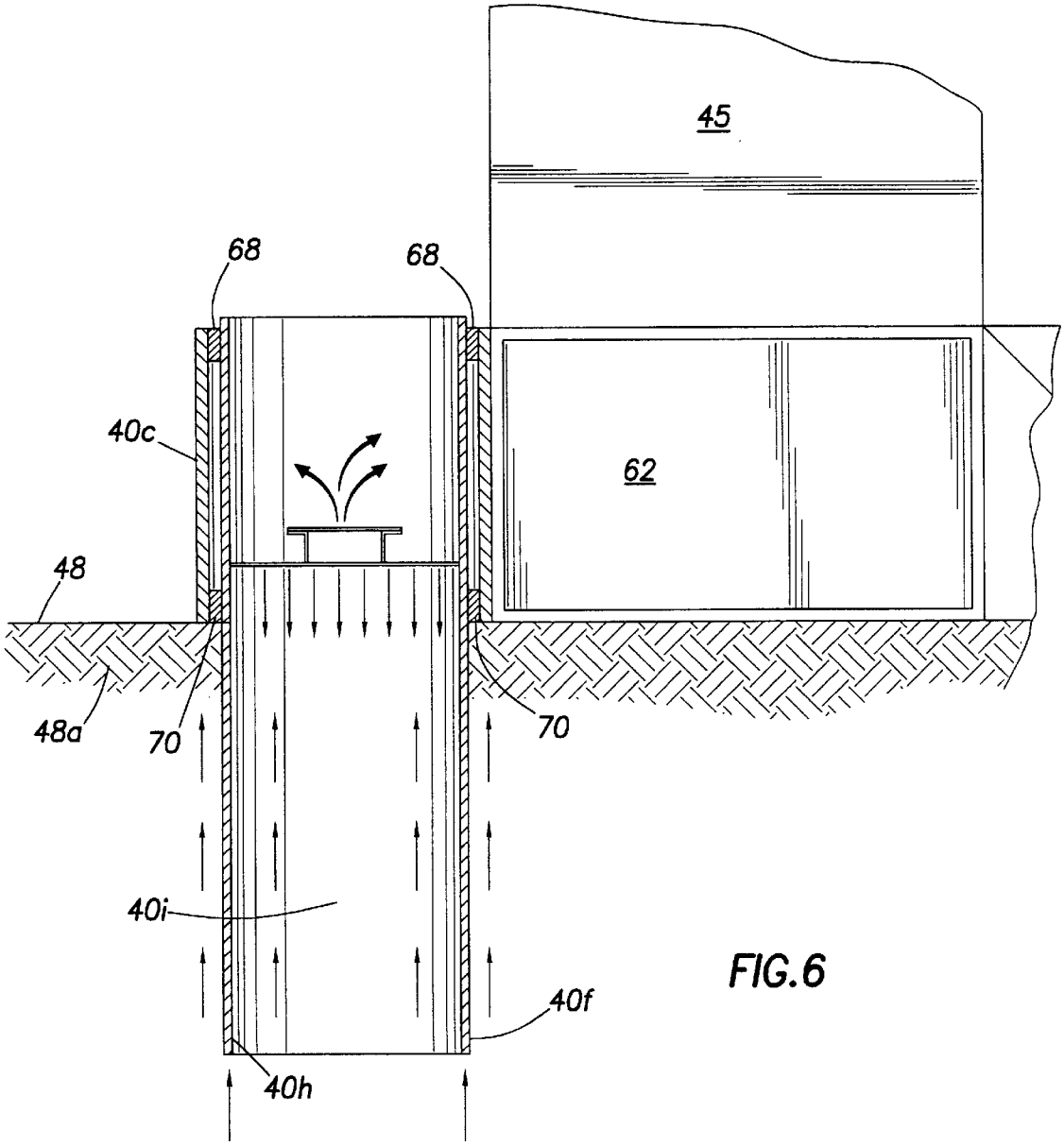
FIG. 6 is a partly-sectional, schematic representation of the pile guide housing including a portion of the pile when it is in its lowermost position as shown in FIG. 7.

FIG. 6 shows the down forces, represented by down arrows and the up forces represented by up arrows, acting on pile 40 during imbedment. The imbedment relies on adding extra downward forces onto pile 40.

In Step 4, if the self-pile-penetration is not sufficient to submerge pile 40 so that suction pump 50 is completely underwater, then high-pressure water is introduced at the base 40*g* of the pile by opening jet valve 11. High-pressure water then flows down jet pipe 16 and jet-flex hose 20 and into the piping network 22 on pile 40. The jetting tips 21 direct the high-pressure water to flush out soil from under the bottom rim 40*g* of pile 40 and thus facilitate further pile penetration.

In Step 5, pile 40 has already sufficiently penetrated to allow suction pump 50 to begin evacuating water from within the pile. The water is discharged via hose 17 and pipe 13. The discharge rate is being controlled by valve 12. The suction pump's water evacuation from within pile 40 creates an under-pressure inside the pile which allows additional down forces to become exerted on pile 40 (FIG. 6).

The performance of suction pump 50 is monitored and controlled by instrumentation within control panel 7. The extent of pile penetration is monitored by mechanical penetrometer 8 and penetrometer conduit 4. Suction pump 50 is turned off when the desired pile penetration is reached.

FIG. 7 shows the position of pile 40 after it was allowed to sufficiently penetrate under its own weight into the foundation 48*a*, after suction pump 50 evacuated water from within pile 40 to create an under-pressure therewithin, and the pile has been pushed to its lowermost level into the earth foundation 48*a*.

After the first imbedment, pile system 39 can be reused on demand, for example, to compensate, if needed, for the settling or shifting of the layers in the earth foundation 48*a*.

After self-contained pile system 39, together with its associated manifolds and control instrumentation means, achieves full imbedment within the earth foundation 48*a* under the seabed 48, pile 40 is able to transfer the expected abnormal over-load lateral forces from MODU 42 to the earth foundation and vice versa, in view of its relatively low 3:1 length-to-diameter ratio, thereby enabling MODU 42 to resist lateral and/or angular displacements relative to foundation 48*a*, and thereby to protect substructure 46 against sliding or displacement relative to seabed 48, arising in response to high waves, storms and other environmental disturbances above predetermined corresponding design levels.

Extraction Sequence

In Step 1, air winch 6 and tackle 5 pull up on pile 40. At the same time, a pressurized fluid, such as sea water or drilling mud, is pumped via valve 10, pipe 15, and hose 19 to create an over-pressure in the interior chamber 40*i* of pile 40 that forcibly extracts the pile from the earth foundation 48*a*.

This upward movement is being monitored by penetrometer 8. If the rate of removal of pile 40 is too slow, or if the pile encounters too much soil resistance to allow extraction, high pressure water is introduced at the pile base 40*g* by opening valve 11 which delivers the water to jetting tips 21 via pipe 16 and hose 20.

In step 2, pile 40 is now fully raised and deballasting of MODU 42 commences.

In step 3, as shown in FIG. 2, padeye 29 detachably secures the top end of pile 40 with locking pin 30 to its normal, raised, uppermost rest position used for transit. MODU 42 is now free-floating and ready for removal from site to another seaway site.

Some Environmental Parameters

| | |
|---|---|
| Water depth (ft) | 9–70 |
| one minute wind speed (knots) | 78 |
| wave heights of (ft) | 25 |
| associated wave period (sec) | 13 |
| maximum draft in hurricane seasons with (ft) | 60 |
| storm surge plus tide (ft) | 5 |
| surface current speed (knots) | 1.6 |
| seabed current speed | 0 |

In use, pile 40 serves as a rigid connector which is able to transfer sufficient lateral forces between MODU 42 and the earth foundation 48*a*, thereby precluding significant pile bending, as well as sliding of the structure's bottom over seabed 48 arising from high waves, storms and other such environmental disturbances.

The sizes and shapes of MODU 42 and water depths are only included herein for illustration purposes and therefore are in no way intended to be limiting.

Various changes may be made in the shape, size and general arrangement of components. For example, equivalent elements may be substituted for those illustrated and described herein, as will be apparent to one skilled in the art.

Accordingly, it is to be understood that the form of the invention herewith shown and described is to be taken as the presently preferred embodiment, and it should be construed as illustrative only and for the purpose of teaching those skilled in the art the manner of carrying out the invention.

It will also be appreciated by those skilled in this insular art that the novel pile system 39 successfully achieves its stated advantages and objectives because it

- is relatively light weight,
- is easy and simple to install, remove and maintain,
- is economical to manufacture,
- is user friendly without interfering with other operations and functions performed on the MODU,
- is economical in the requirement of steps needed during pile deployment and extraction,
- is protective of equipments extending from the structure into the seabed, such as wellheads, and the drill and production pipes,
- is efficiently functional in diverse foundation soils,
- has to itself a dedicated, independent pile lowering and lifting device for use on demand during pile imbedment and extraction, and
- is self-contained in that no external equipment or services are required for its functionality.

What is claimed is:

1. A slide-resistant, bottom-founded structure for use over the waterbed of a relatively shallow waterway, comprising:

at least one pile having a generally circular section and a top end movably mounted on said structure;

a self-contained imbedment system operatively associated with said at least one pile and with said structure for imbedding said at least one pile into the earth foundation underneath said waterbed;

said embedment system including a predetermined suction pump inside said at least one pile;

said at least one pile having a length-to-diameter ratio sufficient to achieve said imbedment of said at least one pile using said predetermined suction pump; and said pump, in use, pumping out water from said at least one pile and creating therewithin a sufficient under-pressure to forcibly imbed said at least one pile into said earth foundation.

2. The slide-resistant, bottom-founded structure according to claim 1, wherein said structure has a hull;

said at least one pile is mounted on said hull of said structure;

said length-to-diameter ratio of said at least one pile is within the range of 0.5:1 to 5:1; and control instrumentation means mounted on said structure and within said at least one pile for controlling the operation of said suction pump, and of said under-pressure within said at least one pile.

3. The slide-resistant, bottom-founded structure according to claim 2, and means supplying a pressurized fluid into said at least one pile when imbedded to create a sufficient over-pressure therewithin to forcibly extract said at least one pile from said earth foundation; and diaphragm means inside said at least one pile for containing said under-pressure during said imbedment and said over-pressure during said extraction.

4. The slide-resistant, bottom-founded structure according to claim 3, and coupling means for releasably coupling said top end of said at least one pile to said structure.

5. The slide-resistant, bottom-founded structure according to claim 4, wherein said coupling means includes a padeye.

6. The slide-resistant, bottom-founded structure according to claim 4, and a pile lowering-and-lifting device operatively mounted on said structure above said at least one pile for lowering said at least one pile to said waterbed during said at least one imbedment of said at least one plie, and for lifting said pile out of said waterbed during said extraction of said at least one pile.

7. The slide-resistant, bottom-founded structure according to claim 6, wherein said lowering-and-lifting device is a winch and tackle apparatus mounted over the center axis of said at least one pile.

8. The slide-resistant, bottom-founded structure according to claim 4, wherein said structure is a submersible structure having a main deck supported on a bottom-founded substructure which, in use, rests on said waterbed at a location subject to severe environmental conditions; and said at least one pile has a substantially circular section; said length-to-diameter ratio of said pile is selected so as to empower said structure to resist sliding over said waterbed.

9. The slide-resistant, bottom-founded structure according to claim 7, and stop-and-guide means on said structure and on said at least one pile for limiting the vertical motion of said top end of said at least one pile during said extraction of said at least one pile, and its rotational motion during said embedment of said at least one pile.

10. The slide-resistant, bottom-founded structure according to claim 9, wherein said at least one pile has drain holes to allow excess water to escape from said at least one pile during said extraction of said at least one pile and to allow free-flooding said at least one pile during said embedment of said at least one pile; and jetting means for directing high-pressure water to the lower end of said at least one pile to assist with said pile's imbedment.

11. A slide-resistant, bottom-founded structure which, in normal use, is stationed at a rest position on the bed of a relatively shallow waterway, comprising:

at least one pile having a top end and a bottom base;

coupling means for releasably and movably coupling said top end to said structure;

an imbedment system operatively coupled to said pile;

said imbedment system including a suction pump mounted inside said at least one pile for forcibly imbedding said base into said bed, thereby increasing the slide resistance of said bottom-founded structure; and control instrumentation means mounted on said structure and on said at least one pile for monitoring and controlling the performance of said suction pump.

12. The slide-resistant, bottom-founded structure according to claim 11, wherein said at least one pile has a generally circular section and a length-to-diameter ratio within a range of 0.5:1 to 5:1.

13. The slide-resistant, bottom-founded structure according to claim 11, and a lowering-and-lifting device operatively coupled to said structure and to said at least one pile for lowering said at least one pile to said bed.

14. The slide-resistant, bottom-founded structure according to claim 13, wherein said lowering-and-lifting device includes a winch-and-tackle apparatus.

15. The slide-resistant, bottom-founded structure according to claim 13, and a fluid supply source for feeding a high-pressure fluid into said at least one pile, when imbedded, thereby extracting said base of said at least one pile from said bed.

16. The slide-resistant, bottom-founded structure according to claim 15, and diaphragm means within said at least one pile for containing the fluid pressure therein during said imbedment of at least one pile and said extraction of said at least one pile.

17. The slide-resistant, bottom-founded structure according to claim 15, wherein said at least one pile has drain holes to allow water to escape therefrom during said extraction of said at least one pile, and to allow free-flooding said at least one pile during said imbedment of said at least one pile.

18. The slide-resistant, bottom-founded structure according to claim 15, and jetting means coupled to said fluid source and to said at least one pile for assisting, when necessary, with said imbedment of said at least one pile and said extraction of said at least one pile.

19. The slide-resistant, bottom-founded structure according to claim 12, wherein said length-to-diameter ratio is selected range to enable said structure to optimally resist sliding over said bed under the worst expected environmental conditions.

20. The slide-resistant, bottom-founded structure according to claim 11, wherein said structure has a hull resting, in use, over said bed; and said at least one pile has a generally circular section and a length-to-diameter ratio within a range of 0.5:1 to 5:1.

21. A slide-resistant, bottom-founded offshore structure which, in normal use, is stationed at a rest position on the seabed of a relatively shallow seaway, comprising:

a plurality of piles, each one of said piles having a top end and a bottom base;

coupling means for releasably and movably coupling said top end of each one of said piles to said structure;

an imbedment system operatively coupled to each one of said piles;

said imbedment system including a suction pump mounted inside each one of said piles for forcibly imbedding each of said pile's base into said seabed, thereby increasing the slide resistance of said bottom-founded structure; and control instrumentation means mounted on said structure and on each one of said piles for monitoring and controlling the performance of each suction pump within each one of said piles.

22. The slide-resistant, bottom-founded offshore structure according to claim 21, wherein each one of said piles has a generally circular section and a length-to-diameter ratio within a range of 0.5:1 to 5:1.

23. The slide-resistant, bottom-founded offshore structure according to claim 22, wherein said length-to-diameter ratio is selected range to enable said structure to optimally resist sliding over said seabed under the worst expected environmental conditions.

24. The offshore structure according to claim 21, wherein said structure has a hull resting, in use, over said seabed;

each one of said piles has a generally circular section and a length-to-diameter ratio within a range of 0.5:1 to 5:1; and stop-and-guide means on said structure and on each one of said piles for limiting the vertical motion of each of said pile's top end during said pile extraction, and its rotational motion during said pile imbedment.

25. The slide-resistant, bottom-founded offshore structure according to claim 21, and a lowering-and-lifting device operatively coupled to said structure and to each one of said piles for lowering each of said pile's base to said seabed.

26. The slide-resistant, bottom-founded offshore structure according to claim 25, wherein said lowering-and-lifting device includes a winch-and-tackle apparatus.

27. The slide-resistant, bottom-founded offshore structure according to claim 25, and a fluid supply source for feeding a high-pressure fluid into each one of said piles, when imbedded, thereby extracting each one of said piles from said seabed.

28. The slide-resistant, bottom-founded offshore structure according to claim 27, and jetting means coupled to said fluid source and to each one of said piles for assisting, when necessary, with said pile imbedment and said pile extraction.

29. The slide-resistant, bottom-founded offshore structure according to claim 27, wherein each one of said piles has drain holes to allow seawater to escape therefrom during said pile extraction, and to allow free-flooding during said pile embedment.

30. The slide-resistant, bottom-founded offshore structure according to claim 27, and diaphragm means within each one of said piles for containing the fluid pressure therein during said pile imbedment and said pile extraction.

* * * * *